US005138854A

United States Patent [19]

Claar et al.

[11] Patent Number: 5,138,854

[45] Date of Patent: Aug. 18, 1992

[54] LOCKING DEVICE FOR A DOOR LOCK IN A MOTOR VEHICLE

[75] Inventors: Klaus Claar, Sindelfingen; Hans Deischl, Jettingen; Rolf Krügener; Peter Robitschko, both of Sindelfingen; Josef Schumacher, Reutlingen, all of Fed. Rep. of Germany

[73] Assignee: Daimler-Benz Aktiengesellschaft, Fed. Rep. of Germany

[21] Appl. No.: 576,194

[22] Filed: Aug. 30, 1990

Related U.S. Application Data

[63] Continuation of Ser. No. 315,610, Feb. 27, 1989, abandoned.

[30] Foreign Application Priority Data

Feb. 27, 1988 [DE] Fed. Rep. of Germany ..... 3806326

[51] Int. Cl.[5] ..... E05B 53/00

[52] U.S. Cl. ..... 70/264; 70/237

[58] Field of Search ..... 70/263, 264, 237, 240, 70/241, 256, 257

[56] References Cited

U.S. PATENT DOCUMENTS

| | | | |
|---|---|---|---|
| 4,225,008 | 9/1980 | Colell et al. | 70/237 X |
| 4,312,197 | 1/1982 | Carrion et al. | 70/240 X |
| 4,342,209 | 8/1982 | Kleefeldt | 70/237 |
| 4,652,027 | 3/1987 | Quantz | 70/241 X |
| 4,719,775 | 1/1988 | Pross et al. | 70/264 |
| 4,815,306 | 3/1989 | Feichtiger et al. | 70/240 |
| 4,848,114 | 7/1989 | Rippe | 70/257 X |
| 4,917,412 | 4/1990 | Swan et al. | 70/264 X |

*Primary Examiner*—Renee S. Luebke
*Assistant Examiner*—Suzanne L. Dino
*Attorney, Agent, or Firm*—Evenson, Wands, Edwards, Lenahan & McKeown

[57] ABSTRACT

A locking device for a door lock in a motor vehicle has a locking position which can be selected, even by remote actuation, by an outer security element and in which the influence of outer and inner lock handles and of inner security elements on this locking position is prevented as a result of an interruption of the force flux at disengageable couplings.

10 Claims, 1 Drawing Sheet

LOCKING DEVICE FOR A DOOR LOCK IN A MOTOR VEHICLE

This is a continuation of application Ser. No. 315,610, filed Feb. 27,1989, now abandoned.

BACKGROUND AND SUMMARY OF INVENTION

The present invention generally relates to an improved locking device for a door lock in a motor vehicle, and more particularly to a locking device which prevents the unauthorized unlocking of a door from the inside.

Locking devices for the door lock of a motor vehicle are known such as disclosed by German Offenlegungsschrift 3,500,550. This specification suggests the possible isolation of an inner handle from the door lock by a coupling which can be remotely controlled as well as mechanically actuated. However, in this arrangement, the isolating coupling is required to be the same isolating coupling which also isolates the outer handle from the door lock when the locking position is selected. Further, the locking position can always be selected and cancelled by an inner security element irrespective of whether the door lock has been locked from the inside, from the outside or by remote control (central locking). Furthermore, the locking position can even be cancelled simply by actuating the inner handle in the process of opening the door from the inside.

Door locks are also known (German Auslegeschrift 2,000,944, German Auslegeschrift 2,522,301), in which both the outer and inner handles are always free-moving, irrespective of whether the vehicle has been locked from outside or from inside, that is to say uncoupled from the door lock. However, the inner security element is blocked with locking from the outside, but with locking from the inside, the inner security element can also cancel again the locking position selected by the inner security element.

In the above-mentioned arrangement, it is not possible to have an inner security element which is countersunk in a locking position and which cannot be grasped by hand. Thus, two actions always have to be performed in order to open even a door locked from the inside.

Additionally, there is already a known combined central-locking and theft-prevention system (German Patent Specification 3,307,542), in which unauthorized opening of any door after the selection of the locking position from outside is prevented by an additional detent pawl brought into engagement with a rotary door-lock latch in a power-operated way.

Furthermore, it is known (German Offenlegungschriften 2,709,157 and 2,709,158) to prevent the release of a door lock by an inner security element, employing a detent for preventing further movement, after an idle stroke of the inner security element. However, these components can exert their effect reliably only when there is continuous activation of associated vacuum-type control elements.

Moreover, in a combined central-locking and break-in/theft alarm system, (German Patent Specification 3,516,732) the control of the break-in/theft alarm system is controlled in a similar manner as the control of the central-locking system, by the same potential-change switch when there is a simultaneous key-recognition signal from a lock-cylinder switch.

An object of the invention is to provide a locking device that is better protected against unauthorized opening from inside, such as to prevent unauthorized opening by a child or after a break-in.

According to the invention, this object is achieved by providing a locking device for a door lock in a motor vehicle having a locking position and a release position selectable from a central location, even by remote actuation, comprising security elements for selecting the locking position of the door lock including a inner security element for manually selecting the locking position of the door lock and at least one outer handle selectively uncoupled from the door lock by an isolating coupling actuated by the security elements. Also included is a connecting arrangement for actuating the isolating coupling to at least assume an uncoupling state upon manual selection of the locking position by the inner security element and an inner handle disengageably coupled to the door lock and adapted to cancel the locking position in the process of opening a particular door when the locking position has been selected manually by the inner security element. A first disengageable coupling is provided for disengageably connecting the inner handle to the door lock, the first disengageable coupling being disengageable during the selection of the locking position from the outside of the vehicle, only indirectly by a first actuating drive. Further, the connecting arrangement, between the inner security element and the isolating coupling, is uncoupleable at least in a lock releasing direction of actuation of the inner security element.

It is presupposed, in accordance with certain preferred embodiments of the present invention, that the "selection of the locking position from outside" can be triggered remotely, for example, by a security element or control element of a central-locking system, under the control of, for example, a lock cylinder on another door.

In accordance with certain advantageous features of preferred embodiments of the present invention, the locking device provides expedient possibilities of use on door locks with outer security elements and/or a child-proof facility. Child-proof facility, as used herein, refers to being able to secure a door against careless opening from inside, but at the same time not having to lock this door against opening from outside.

The locking device according to the invention also provides two different options for preventing unauthorized use of the inner security element in the releasing direction of actuation.

Other objects, advantages and novel features of the present invention will become apparent from the following detailed description of the invention when considered in conjunction with the accompanying drawings.

DETAILED DESCRIPTION OF THE DRAWINGS

Figure 1:
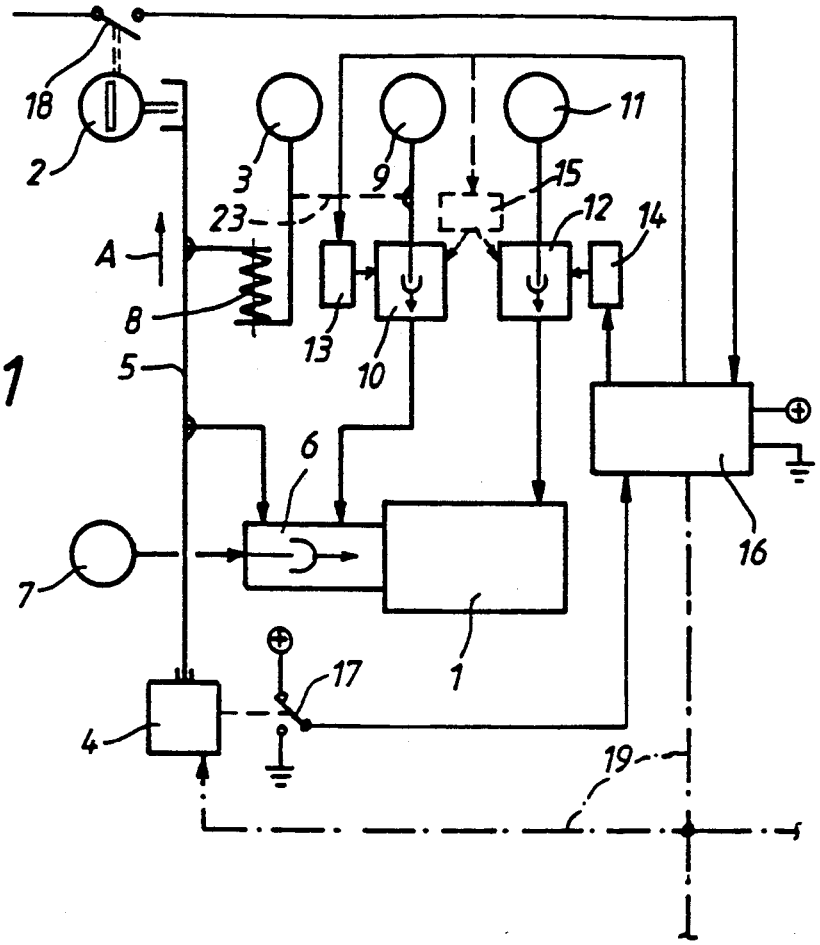
FIG. 1 diagrammatically illustrates a locking device for a (driver's) door lock with a lock cylinder and with two separate inner security elements in accordance with the teachings of the present invention.

A locking device in accordance with the teachings of the present invention is shown in FIG. 1 for a door lock 1 which includes an outer security element, such as for example, a lock cylinder 2, a first inner security element 3 and a remotely controllable security element such as, for example, a central-locking control element 4.

These three security elements 2, 3 and 4 act via a connection 5, such as, for example, a mechanical connection on an isolating coupling 6 to select the locking position of the door lock 1. The isolating coupling 6 is arranged between the door lock 1 and an outer handle 7 and can be disengaged by the security elements 2, 3 and 4 for isolating the outer handle 7 from the door lock 1. The cancellation of this locking position, which is carried out by a movement of the connection 5 in the direction of the arrow A, is initially possibly only with the security elements 2 and 4. The first inner security element 3 is uncoupled kinematically from the connection 5 against manual actuation in this direction by a spring-prestressed loose connection 8. The spring merely serves for driving the first inner security element 3, for example designed as an inner security knob, reliably even in the event of remote actuation, for the purpose of indicating the locking state. It is so weak that it is not possible to cancel the locking position by means of the first inner security element 3.

A second inner security element 9 is connected via a first disengageable coupling 10 to the isolating coupling 6 for the actuation of the isolating coupling 6. Additionally, an inner handle 11 is connected to the door lock 1 via a second disengageable coupling 12. Any device suitable for keeping a motor-vehicle door in the closed position is designated here, in general terms, as a door lock. In particular, for example, the conventional combination of a rotary latch and of a detent pawl can form the "door lock", the handles acting on the detent pawl in order to open the doors. An actuating drive 13, 14 is assigned to each of the two disengageable couplings 10, 12 for actuating them in the direction of disengagement and engagement. Alternatively, a common actuating drive 15, represented by broken lines, is provided for the two couplings 10, 12 if there is a suitable constructive design of the locking device, since, in principle, the two couplings 10, 12 are to be disengaged and engaged simultaneously.

The isolating coupling 6 and the first and second disengageable couplings 10, 12 represented merely symbolically by a broken force-flux arrow, are therefore actuated by the security elements or actuating drives connected to them via linkages, regulating members or the like, symbolically represented by arrows of action pointing transversely relative to the force-flux arrow.

In order to control the actuating drives 13 and 14 or 15 to be activated from outside only during the selection of the locking position, a signal evaluation circuit 16 is provided such as, for example, disclosed in U.S. application Ser. No. 264,542, filed Oct. 31, 1988, and assigned to the assignee of the present application, the entire disclosure of which is herein incorporated by reference. This circuit 16 receives potential-change signals from an electrical changeover switch 17 which is coupled mechanically to the central-locking control element 4 and which, for example, carries a negative electrical potential in the locking position and a positive electrical potential in the release position. The signal evaluation circuit 16 receives electrical key-recognition signals from an electrical key-recognition arrangement 18, when a suitable key (not shown) is used in the outer security element 2 in order to select or cancel the locking position. This effect is represented by a broken double line.

In response to potential-change signals alone, these being present, for example, when the first inner security element 3 is actuated counter to the direction of the arrow A, the signal evaluation circuit 16, via a connection system indicated by dot-and-dash lines, controls a central-locking system (not shown) which also contains the control element 4. If, in addition, there is also a key-recognition signal from the arrangement 18, the actuating drives 13 and 14 or 15 are likewise activated by the signal evaluation circuit 16, specifically in accordance with the particular potential-change signal present at the same time from the switch 17.

Thus, when the locking position is selected by a key at the outer security element 2, then as a result of the potential change of the switch 17 from positive to negative, the central-locking system is controlled in the locking direction and the isolating coupling 6 is disengaged. Further, as a result of the signal combination of a potential change of the switch 17 from positive to negative plus the key-recognition signal, the couplings 10 and 12 are disengaged by the actuating drives 13 and 14 or the common actuating drive 15.

Unauthorized persons are thereby deprived of any possibility of cancelling the locking position by means of any handle or any security element without the use of force.

Figure 2:
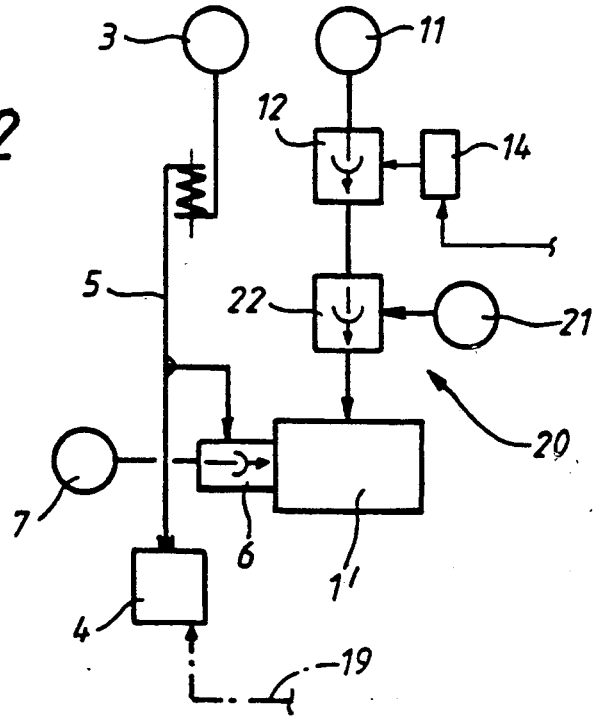
FIG. 2 diagrammatically illustrates a locking device for a (rear) door lock without a lock cylinder, but with a child-proof facility in accordance with the teachings of the present invention.

For a rear-door lock 1', FIG. 2 illustrates a locking device in accordance with the teachings of the present invention without an outer security element, but with a child-proof facility generally at 20 which is composed of a lever handle 21 and of a coupling 22 or the like, the handle 21 being manually disengageable in a known way by the coupling 22. The child-proof facility 20 is connected mechanically in series with the already described disengageable coupling 12 within the force flux of the inner handle 11 and is to be actuated completely independently. Otherwise, the arrangement according to FIG. 2 corresponds essentially to that according to FIG. 1, this being emphasized by identical reference symbols for like components.

The second inner security element 9 is omitted in the embodiment illustrated by FIG. 2.

The first inner security element 3 and the second inner security element 9 of FIG. 1 can also be designed in constructive terms, in such a way that both can be uncoupled from the actuation of the isolating coupling 6 via the same disengageable coupling 10. A connection 23 represented by a broken line indicates this. If this connection 23 is provided, there is no need for the loose connection 8 of the first inner security element 3 to the connection 5.

As already mentioned, the first inner security element could then be used merely as a means of indicating the locking state, whilst the second inner security element 9 would have to be arranged on the inside of the door as a manually actuable slide or the like invisible from outside.

Finally, of course, there must be a mechanically acting arrangement, not shown in the Figures, which, when the door is released and opened from inside, necessarily brings the isolating coupling of the outer handle into engagement again. This arrangement can, for example, be controlled advantageously by means of the movement of a rotary latch.

Of course, a receiver of an infrared remote control, the transmitter of which corresponds in functional terms to the key fitting the lock cylinder, also comes under consideration as an outer security element.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A locking device for a door lock in a motor vehicle having a locking position and a release position selectable from a central location, even by remote actuating, comprising:

(a) security elements operatively arranged for selecting the locking position of the door lock, including a manually actuated inner security element for manually selecting the locking position of the door lock through an operative engagement with an isolating occupying selectively movable in relation to the door lock to effect the locking position and the release position;

(b) at least one outer handle operatively arranged to open the door lock and also to be selectively uncoupled from the door lock via the isolating occupying associated with the door lock and actuated by the security elements;

(c) a connecting arrangement between the inner securing element and the isolating coupling for actuating the isolating coupling to at least assume an uncoupled state upon manual selection of the locking position via the inner security element;

(d) an inner handle engageable and disengageably coupled to the door lock and operatively arranged to move the door lock from the locking position to the release position for opening an associated door;

(e) a disengageable coupling for disengageably connecting the inner handle to the door lock, the disengageable coupling being operatively connected with one of a first actuating drive and a common actuating drive so as to be disengageable from outside the vehicle during the selection of the locking position only indirectly by the first actuating drive, each actuating drive being activable in response to an electric key recognition signal generated by an electric key recognition arrangement when the vehicle is locked from the outside; and (f) the connecting arrangement between the inner securing element and the isolating coupling being operatively connected so as to be selectively uncoupleable at least in a lock releasing direction of actuation of the inner security element preventing, in its uncoupled state, the door lock from being unlocked by the inner security element.

2. A locking device according to claim 1, wherein the inner security element both selects and cancels the locking position and is connected to the isolating coupling by a first disengageable coupling disengageable from outside of the vehicle during the selection of the locking position only indirectly by a second actuating drive.

3. A locking device according to claim 2, wherein a common actuating drive is provided for the synchronous actuation of the first and second disengageable couplings.

4. A locking device according to claim 1, further comprising an additional inner security element provided only for selecting the locking position, the additional inner security element being connected to the isolating coupling by a loose connection permanently free-moving in a lock releasing direction against manual actuation.

5. A locking device according to claim 1, further comprising an outer security element, actuated only by a key, for at least actuating the isolating coupling between the at least one outer handle and the door lock, the outer security element being equipped with the electric key-recognition arrangement for the indirect control of the actuating drive of the first and second disengageable couplings.

6. A locking device according to claim 5, further comprising:

a) a central-locking control element, moveable mechanically into the locking and the release position at least by the outer security element, for actuating at least the isolating coupling between the at least one outer handle and the door lock;

b) an electrical switch, coupled to the central-locking control element, and having different potentials in the release position and the locking position; and c) a signal evaluation circuit for controlling each actuating drive of the first and second disengageable couplings upon the simultaneous occurance of a signal from the electrical key-recognition arrangement and a potential change of the electrical switch.

7. A locking device according to claim 1, further comprising a child-proof facility arranged mechanically in series with the first disengageable coupling of the inner handle, the child-proof facility including a lever handle and a third disengageable coupling.

8. A locking device according to claim 4, wherein the loose connection of the additional inner security element to the isolating coupling is spring-prestressed.

9. A locking device according to claim 1, wherein the inner security element only selects the locking position and is connected to the isolating coupling by a loose connection permanently free-moving in a lock releasing direction against manual actuation.

10. A locking device according to claim 9, wherein the loose connection of the additional inner security to the isolating coupling is spring-prestressed.

* * * * *